US008713953B1

(12) United States Patent
Tucker

(10) Patent No.: US 8,713,953 B1
(45) Date of Patent: May 6, 2014

(54) SALAD CARRIER

(76) Inventor: Jean Tucker, White Plains, NY (US)

( * ) Notice: Subject to any disclaimer, the term of this patent is extended or adjusted under 35 U.S.C. 154(b) by 638 days.

(21) Appl. No.: 12/916,893

(22) Filed: Nov. 1, 2010

(51) Int. Cl.

| | |
|---|---|
| ***A47F 3/04*** | (2006.01) |
| ***F25D 21/00*** | (2006.01) |
| ***F25D 3/08*** | (2006.01) |
| ***F25D 25/00*** | (2006.01) |
| ***F25D 25/02*** | (2006.01) |

(52) U.S. Cl.
USPC ..... 62/246; 62/237; 62/251; 62/371; 62/378; 62/382

(58) Field of Classification Search
USPC ..... 62/237, 246, 251, 371, 378, 382, 457.1, 62/457.6, 457.9
See application file for complete search history.

(56) References Cited

U.S. PATENT DOCUMENTS

| | | | | |
|---|---|---|---|---|
| 3,733,836 | A | 5/1973 | Corini | |
| 3,797,563 | A | 3/1974 | Hoffmann et al. | |
| 4,027,727 | A * | 6/1977 | Pullens | 165/48.1 |
| 4,250,955 | A * | 2/1981 | Plattner et al. | 165/244 |
| D294,761 | S | 3/1988 | Gallery et al. | |
| 5,247,807 | A | 9/1993 | Jarman et al. | |
| 5,437,165 | A * | 8/1995 | White et al. | 62/465 |
| 5,797,445 | A * | 8/1998 | Westbrooks et al. | 165/11.1 |
| 5,887,436 | A * | 3/1999 | Duddleston | 62/3.62 |
| 5,924,289 | A * | 7/1999 | Bishop, II | 62/3.61 |
| 6,073,547 | A | 6/2000 | Westbrooks et al. | |
| 6,131,929 | A | 10/2000 | Haley | |
| 6,209,346 | B1 * | 4/2001 | Frosch | 62/457.7 |
| 6,460,950 | B2 | 10/2002 | Spritzer et al. | |
| 6,742,792 | B1 * | 6/2004 | Hooper et al. | 280/79.3 |
| 6,895,778 | B1 | 5/2005 | Ackerman | |
| 7,387,305 | B2 * | 6/2008 | Vanderberg et al. | 280/47.26 |
| 7,536,868 | B1 * | 5/2009 | Ward | 62/237 |
| 2005/0146255 | A1 | 7/2005 | Sabo et al. | |
| 2006/0059934 | A1 * | 3/2006 | Howington et al. | 62/256 |

* cited by examiner

*Primary Examiner* — Frantz Jules
*Assistant Examiner* — Erik Mendoza-Wilkenfel

(57) ABSTRACT

The salad carrier is a mobile cart having an internal space organized via a plurality of adjustable and removable shelves. The internal space is accessible via one of a plurality of doors located thereon. The internal space is refrigerated via a refrigeration unit located on a side of the mobile cart, and of which is powered via a rechargeable battery pack. The mobile cart is mobilized via a plurality of caster wheels and a telescoping handle that can extend and retract and of which can rotate up or down.

7 Claims, 6 Drawing Sheets

SALAD CARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of push carts, more specifically, a refrigerated push cart that is designed to support a plurality of salads.

B. Discussion of the Prior Art

As a preliminary note, it should be stated that there is an ample amount of prior art that deals with salad supporting devices. As will be discussed immediately below, no prior art discloses a salad carrier in the form of a cart having a telescoping handle as well as a refrigeration unit that is portably powered and of which contains a plurality of doors accessing an internal space organized via a plurality of adjustable and removable shelves; wherein a plurality of containers are included to isolate the various components of a salad such that a salad may be made as needed.

The Ward Patent (U.S. Pat. No. 7,536,868) discloses a temperature controlled cart for carrying items such as food, beverages, and menu items. However, the cart is incapable of being lifted via a handle, or have a telescoping handle that can rotate as well as a refrigeration unit that is portably powered.

The Ackerman Patent (U.S. Pat. No. 6,895,778) discloses a wheeled food container that has removable partitions. However, the wheeled food container is not personally liftable via a handle located thereon and of which does not include a refrigeration unit that is portably powered.

The Westbrooks, Jr. et al. Patent (U.S. Pat. No. 6,073,547) discloses a food temperature maintenance cart having a refrigeration unit.

The Haley Patent (U.S. Pat. No. 6,131,929) discloses a portable, modular, refrigerated service cart. However, the cart does not enclose a refrigerated interior with a plurality of shelves that store various items used to construct or a finished salad therein.

The Jarman et al. Patent (U.S. Pat. No. 5,247,807) discloses a salad bar with replaceable modular refrigerated condiments container. However, the device is directed to a salad bar and not a highly portable and liftable salad carrier that has a refrigerated interior.

While the above-described devices fulfill their respective and particular objects and requirements, they do not describe a salad carrier in the form of a cart having a telescoping handle as well as a refrigeration unit that is portably powered and of which contains a plurality of doors accessing an internal space organized via a plurality of adjustable and removable shelves; wherein a plurality of containers are included to isolate the various components of a salad such that a salad may be made as needed. In this regard, the salad carrier departs from the conventional concepts and designs of the prior art.

SUMMARY OF THE INVENTION

The salad carrier is a mobile cart having an internal space organized via a plurality of adjustable and removable shelves. The internal space is accessible via one of a plurality of doors located thereon. The internal space is refrigerated via a refrigeration unit located on a side of the mobile cart, and of which is powered via a rechargeable battery pack. The mobile cart is mobilized via a plurality of caster wheels and a telescoping handle that can extend and retract and of which can rotate up or down.

It is an object of the invention to provide a salad carrier consisting of a mobile cart that includes a refrigerated internal space that houses components used to construct or finished salads.

A further object of the invention is to provide a salad carrier with a telescoping handle used to propel and control the salad carrier that also includes at least one caster wheel to mobilize the salad carrier.

A further object of the invention is to provide a refrigeration unit that cools the internal space and of which is powered via a rechargeable battery.

A further object of the invention is to provide at least one door that opens to access the internal space.

A further object of the invention is to include a plurality of shelves that can be adjusted vertically or removed from the internal space.

A further object of the invention is to provide a plurality of shelves each with at least one cutout of a predefined shape that supports bowls and containers thereon so as to prevent movement of said items during transit.

A further object of the invention is to include a cover that slides over the salad carrier in order to protect the salad carrier and contents contained therein from sunlight and other atmospheric phenomena.

These together with additional objects, features and advantages of the salad carrier will be readily apparent to those of ordinary skill in the art upon reading the following detailed description of presently preferred, but nonetheless illustrative, embodiments of the salad carrier when taken in conjunction with the accompanying drawings.

In this respect, before explaining the current embodiments of the salad carrier in detail, it is to be understood that the salad carrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the salad carrier.

It is therefore important that the claims be regarded as including such equivalent construction insofar as they do not depart from the spirit and scope of the salad carrier. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
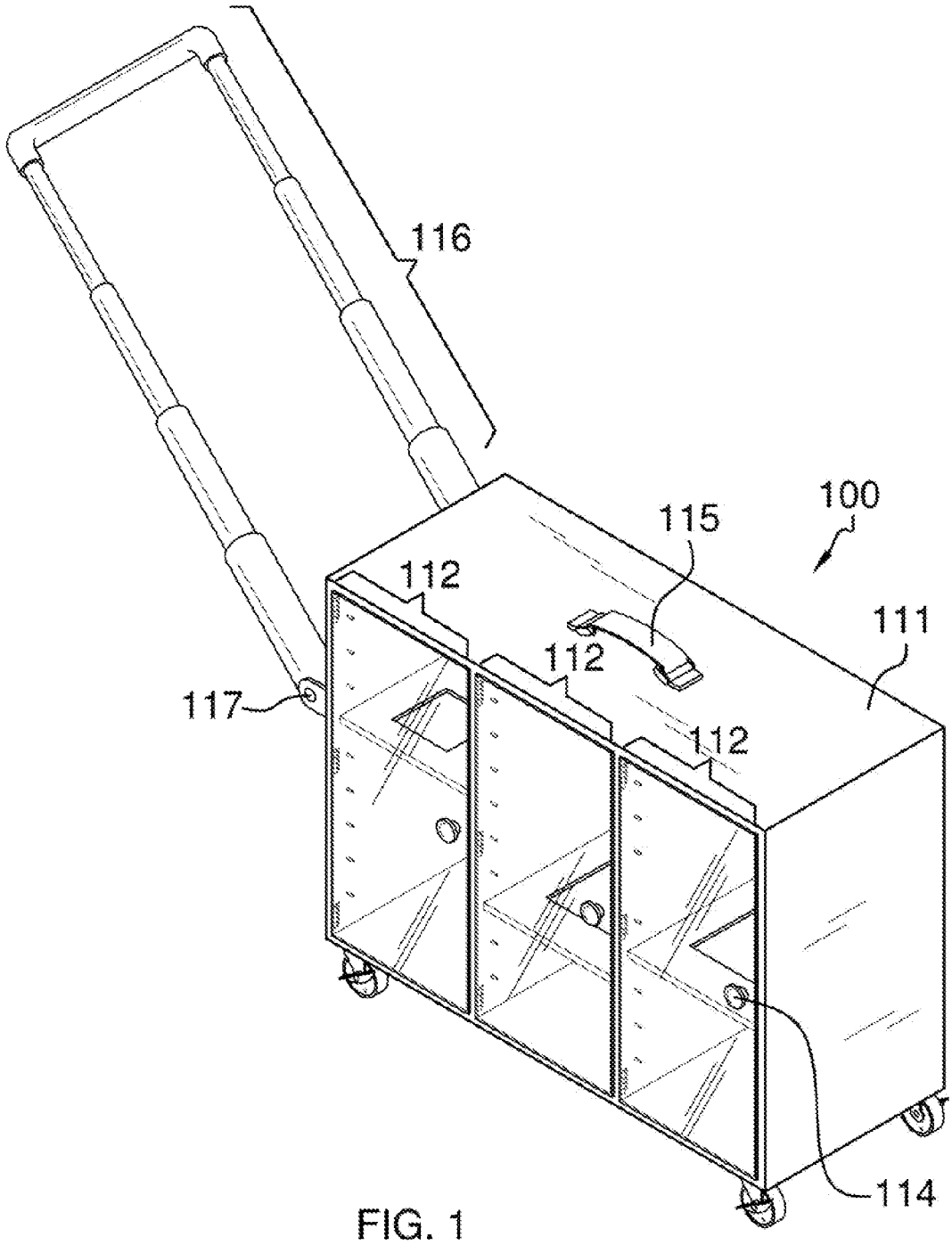
FIG. 1 illustrates a front, isometric view of the salad carrier by itself and ready for transporting.
Figure 2:
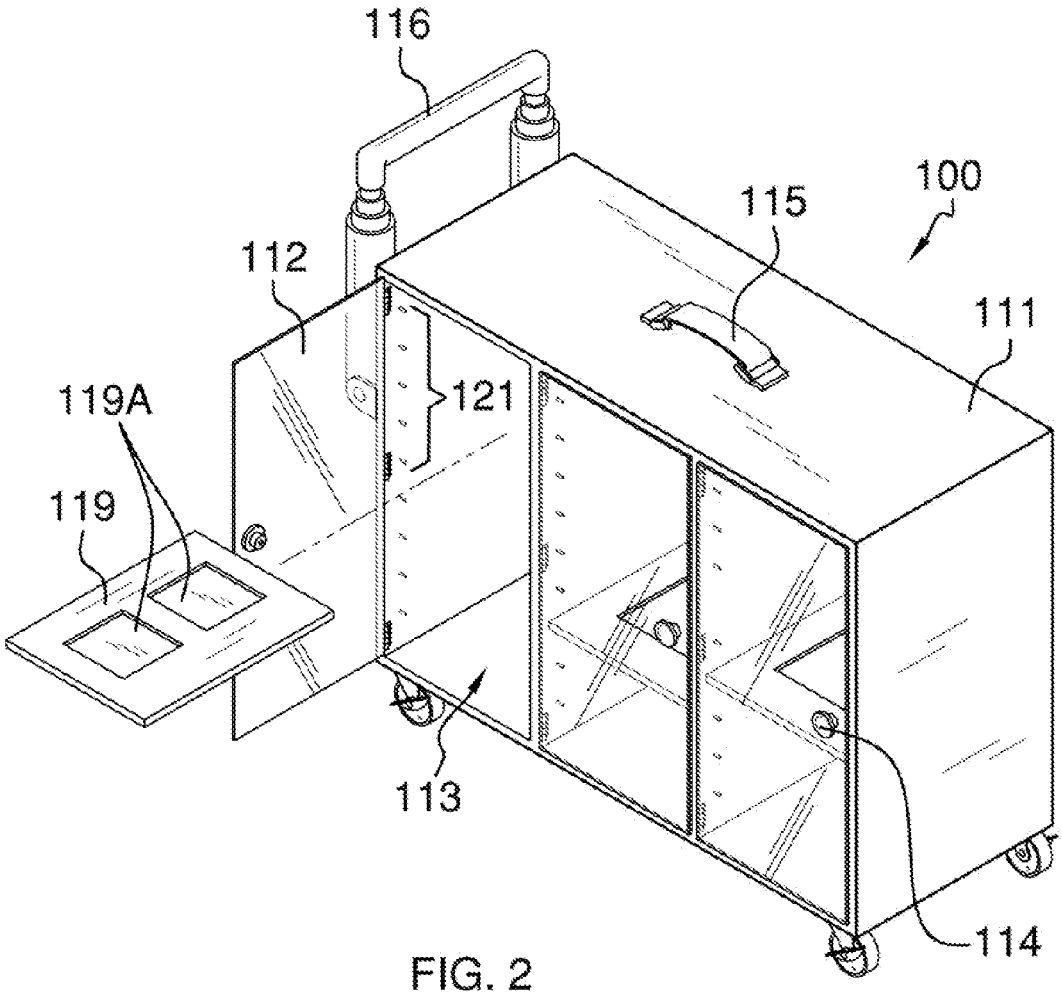
FIG. 2 illustrates a front, isometric view of the salad carrier with the telescoping handles rotated vertically and retracted, and one of the doors opened and a shelf removed; and wherein said shelf depicts cutouts located thereon for the support of containers therein.
Figure 3:
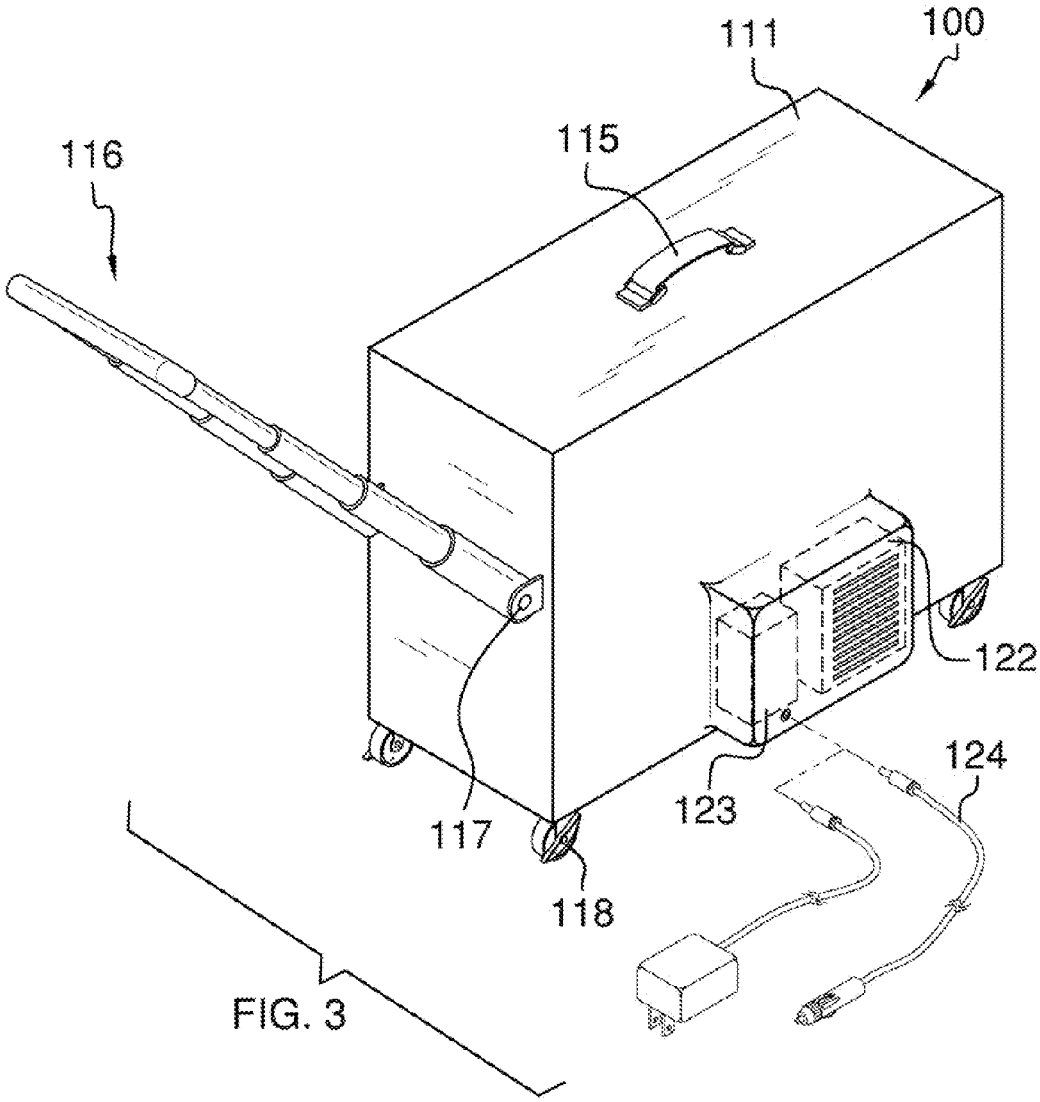
FIG. 3 illustrates a rear, isometric view of the salad carrier with the refrigeration unit and rechargeable battery pack depicted in dashed line and with an electrical cord having either a standard wall outlet plug or a cigarette lighter adapter for use in a vehicle.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A salad carrier 100 (hereinafter invention) includes a housing 111 that includes at least one door 112 located on a side of said housing 111. The doors 112 open and close to provide access to an internal space 113 located within the housing 111.

The doors 112 are made from a clear material such that the internal space 113 is visible from outside of the invention 100. The doors 112 include a knob 114 that enables the door 112 to be pulled open or closed.

Figure 4:
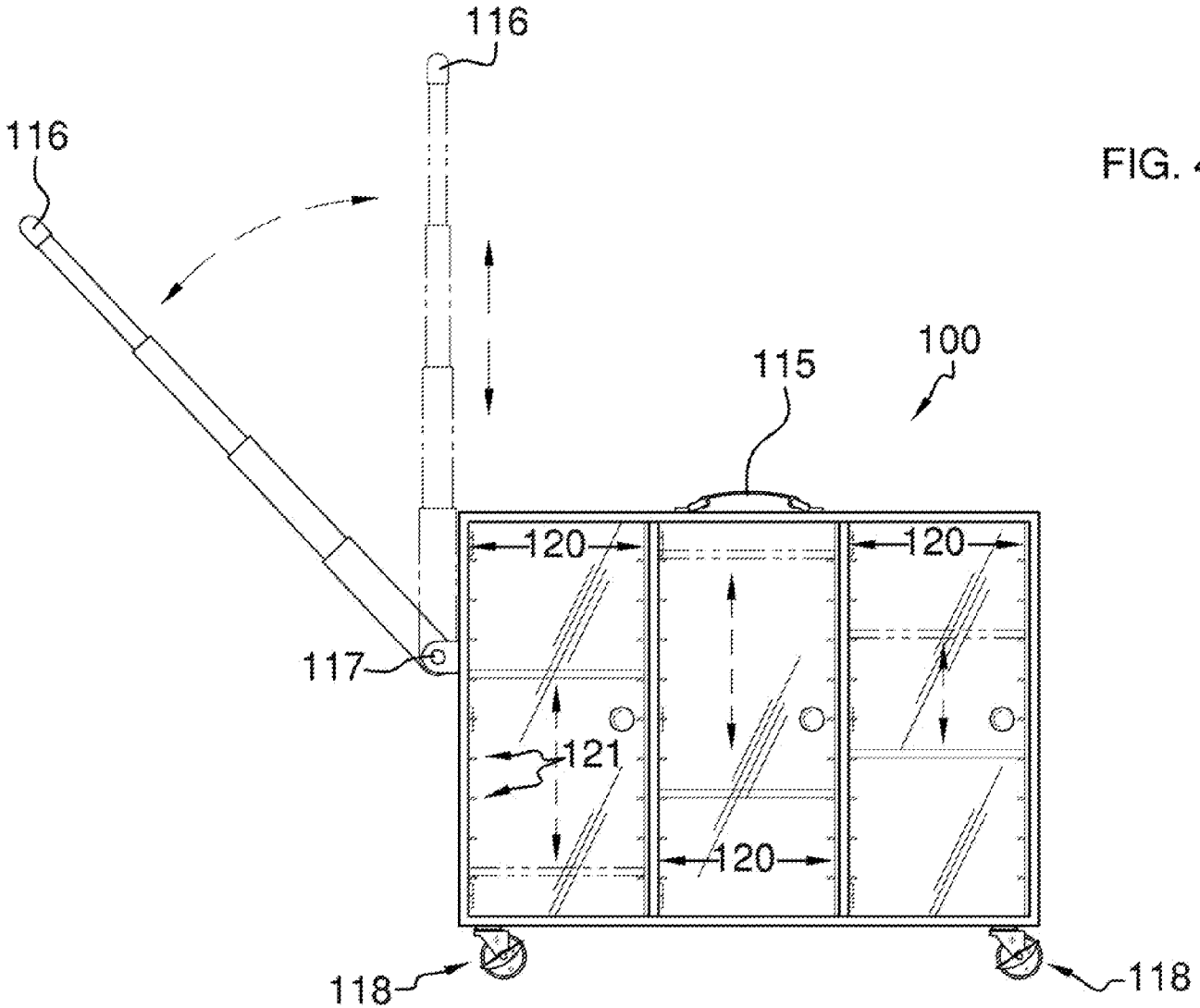
FIG. 4 illustrates a side view of the salad carrier depicting rotating and extension of the telescoping handles as well as vertical arrows indicating vertical movement of the adjustable shelves.

The housing 111 has a handle 115 located on a top surface such that the entire invention 100 can be lifted manually. The housing 111 includes a telescoping handle 116 that is attached on a side surface of the housing 111. The telescoping handle 116 can extend and retract to varying lengths as specified by the end user. The telescoping handle 116 can also rotate about a pivoting point 117 as depicted in FIG. 4. The telescoping handle 116 is included as a means to propel and control the invention 100 when in transmit.

Located and connected under the housing 111 is a plurality of caster wheels 118. The caster wheels 118 enable the invention 100 to be mobilized via the telescoping handle 116.

Located within the internal space 113 is a plurality of shelves 119. The internal space 113 may be divided into internal compartments 120 that each include tabs 121. The shelves 119 can be removed from within the respect internal compartment 120 of the internal space 113. The shelves 119 rest on the tabs 121 to support the shelves 119 at different elevations within the internal compartment 120 of the internal space 113. The internal compartments 120 may align with and correspond with the doors 112 adorning the side of the housing 111.

The internal space 113 is refrigerated via a refrigeration unit 122 that is mounted on a side of the housing 111. The refrigeration unit 122 is powered via a rechargeable battery 123, and is capable of refrigerating the entire internal space 113 contained within the housing 111.

The rechargeable battery 123 is capable of recharging via an electrical cord 124 that has a cigarette lighter plug 124A that plugs into a cigarette lighter of a car or a standard wall outlet plug 124B for use with a standard wall outlet. The invention 100 is designed to be highly mobile and likely to be lifted into and from a car by an end user.

Figure 5:
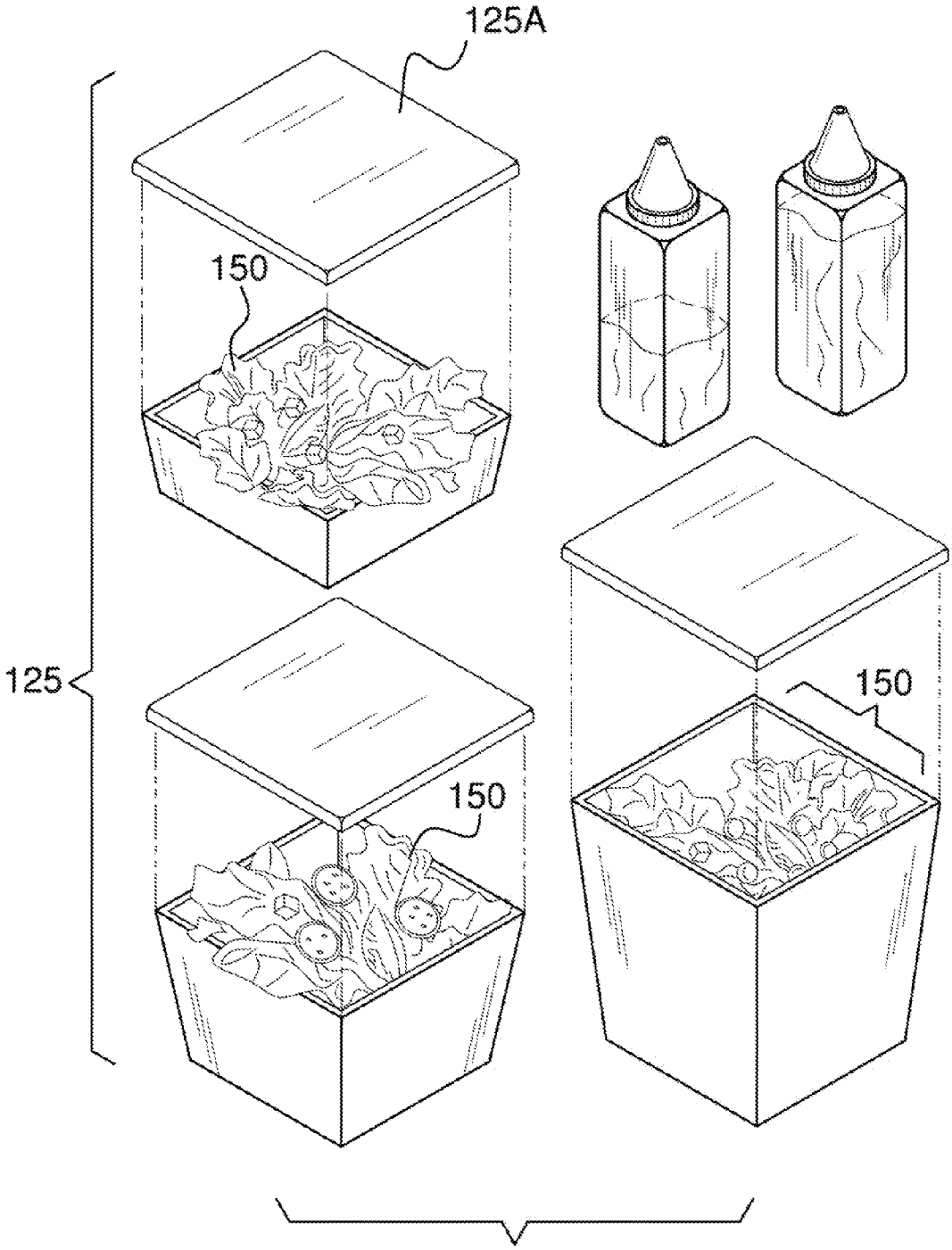
FIG. 5 illustrates a view of the various items that are included with the salad carrier and of which separate components of a salad; wherein snap-on lids are included to seal of the various bowls and/or containers depicted therein.

Storage containers 125, depicted in FIG. 5, can store all components 150 used to create a salad 150 or to store a constructed salad 150. The invention 100 is further defined for use in storing, refrigerating, and transporting at least one salad or the foods individually used to construct a salad. Each storage container 125 may include a snap-on lid 125A that is designed to contain the salad 150 therein, and of which prevents salad 150 from escaping when unintended.

The shelves 119 each may include at least one cutout 119A that is designed to accommodate one or mote of the storage containers 125. The cutouts 119A insure that the storage container 125 is secured to the respective shelf 119 such that the storage container 125 does not shift or rotate when the invention 100 is in transit.

Figure 6:
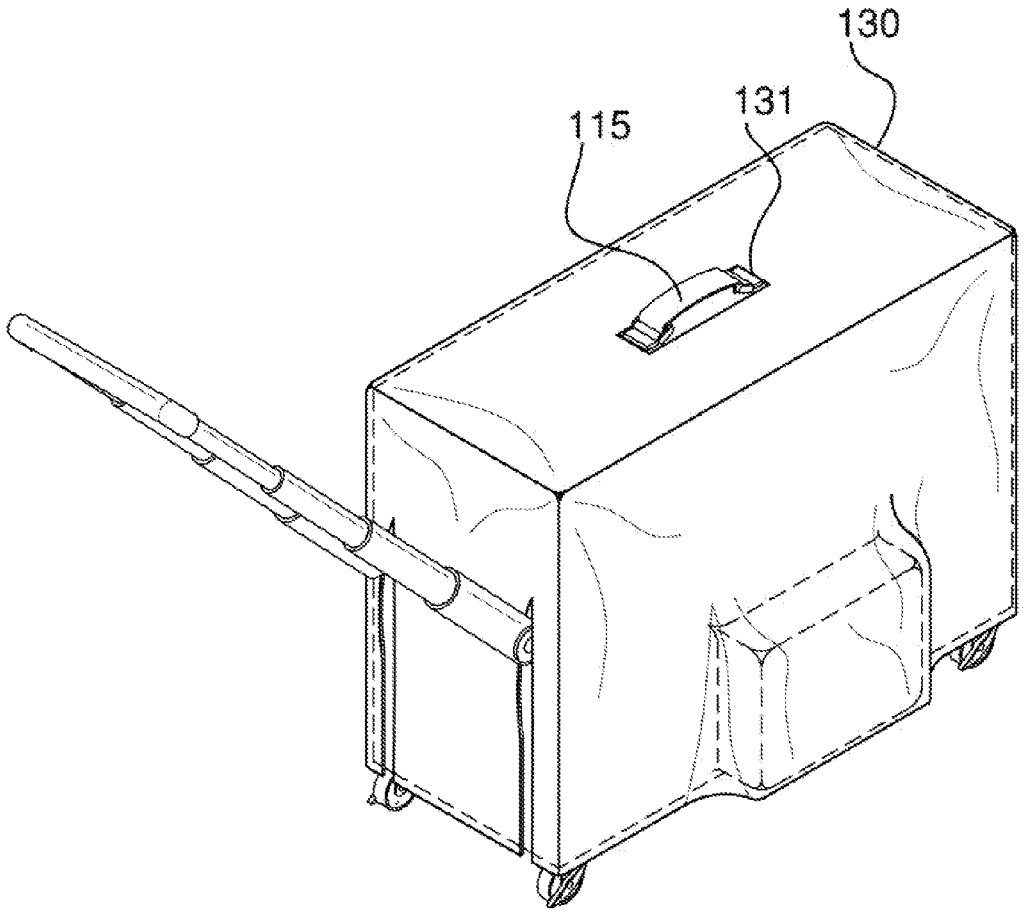
FIG. 6 illustrates an isometric view of the salad carrier outfitted with a cover to conceal and protect both the salad carrier and contents contained therein.

Referring to FIG. 6, the invention 100 includes a cover 130 that is designed to be draped over the invention 100. The cover 130 is made of a non-translucent material that will prevent sunlight from entering into the invention 100 and spoiling the contents therein. The cover 130 features a handle opening 131 that enables the handle 115 to be accessible outside of the cover 130.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A salad carrier device comprising:

a housing defining an internal space that is refrigerated via a refrigeration unit that is located on a side surface of the housing;

a handle is located on a top surface of the housing in order to manually carry the entire salad carrier device;

a plurality of shelves that can be adjusted to different elevations within the internal space;

wherein a plurality of caster wheels rest beneath the housing to mobilize the housing;

wherein a telescoping handle extends from the housing and aids in pushing and controlling the housing;

wherein storage containers are stored within the internal space at a refrigerated temperature and contain components used to construct a salad or a finished salad;

wherein at least one door is located on a side surface of the housing and provides access into the internal space;

wherein each door has a knob used to open and close the respective door;

wherein the door is made of a clear material;

wherein the refrigeration unit is powered via a rechargeable battery;

wherein the rechargeable battery is powered via an electrical cord;

wherein the electrical cord includes a cigarette lighter plug that plugs into a cigarette lighter of a vehicle or a standard wall outlet plug that plugs into a standard wall outlet;

wherein the telescoping handle can rotate about a pivoting point disposed on an upper side surface of the housing;

wherein the internal space is divided into internal compartments;

wherein the internal compartments correspond and are adjacent with the doors; wherein the storage containers each include a snap-on lid to seal off the contents.

2. The salad carrier as described in claim 1 wherein tabs are located on the sides of the internal compartments are used to support the shelves therein at varying elevations within the internal compartments; wherein a cover is included and which is draped over the salad carrier during transit in order to protect the salad carrier and contents contained therein from spoiling due to sunlight or other atmospheric phenomena.

3. A salad carrier device comprising:

a housing defining an internal space that is refrigerated via a refrigeration unit that is located on a side surface of the housing;

a handle is located on a top surface of the housing in order to manually carry the entire salad carrier device;

a plurality of shelves can be adjusted to different elevations within the internal space;

wherein a plurality of caster wheels rest beneath the housing to mobilize the housing;

wherein a telescoping handle extends from the housing and aids in pushing and controlling the housing;

wherein the telescoping handle can rotate about a pivoting point disposed an upper side surface of the housing;

wherein storage containers are stored within the internal space at a refrigerated temperature and contain components used to construct a salad or a finished salad;

wherein the storage containers each include a snap-on lid to seal off the contents;

wherein at least one door is located on a side surface of the housing and provides access into the internal space;

wherein each door has a knob used to open and close the respective door;

wherein the internal space is divided into internal compartments and correspond with the door;

wherein a cover is included and of which is draped over the salad carrier during transit in order to protect the salad carrier and contents contained therein from spoiling due to sunlight or other atmospheric phenomena;

wherein the refrigeration unit is powered via a rechargeable battery;

wherein the rechargeable battery is powered via an electrical cord;

wherein the door is made of a clear material.

4. The salad carrier as described in claim 3 wherein the electrical cord includes a cigarette lighter plug that plugs into a cigarette lighter of a vehicle or a standard wall outlet plug that plugs into a standard wall outlet.

5. The salad carrier as described in claim 3 wherein tabs are located on the sides of the internal compartments are used to support the shelves therein at varying elevations within the internal compartments; wherein each shelf has at least one cutout in which one of the storage containers is seated and secured.

6. A salad carrier device comprising:

a housing defining an internal space that is refrigerated via a refrigeration unit that is located on a side surface of the housing;

a handle is located on a top surface of the housing in order to manually carry the entire salad carrier device;

a plurality of shelves can be adjusted to different elevations within the internal space;

wherein a plurality of caster wheels rest beneath the housing to mobilize the housing;

wherein a telescoping handle extends from the housing and aids in pushing and controlling the housing;

wherein the telescoping handle can rotate about a pivoting point disposed on an upper side surface of the housing;

wherein storage containers are stored within the internal space at a refrigerated temperature and contain components used to construct a salad or a finished salad;

wherein the storage containers each include a snap-on lid to seal off the contents;

wherein at least one door is located on a side surface of the housing and provides access into the internal space;

wherein each door has a knob used to open and close the respective door;

wherein the internal space is divided into internal compartments and correspond with the doors;

wherein tabs are located on the sides of the internal compartments are used to support the shelves therein at varying elevations within the internal compartments;

wherein each shelf has at least one cutout in which one of the storage containers is seated and secured;

wherein the refrigeration unit is powered via a rechargeable battery; wherein a electrical cord includes a cigarette lighter plug that plugs into a cigarette lighter of a vehicle or a standard wall outlet plug that plugs into a standard wall outlet;

wherein a cover is included and which is draped over the salad carrier in order to protect the salad carrier and contents contained therein from spoiling due to sunlight or other atmospheric phenomena.

7. The salad carrier as described in claim 6 wherein the door is made of a clear material.

* * * * *